US008784132B2

(12) United States Patent
Cossette

(10) Patent No.: US 8,784,132 B2
(45) Date of Patent: Jul. 22, 2014

(54) ELECTRICAL CONNECTOR ASSEMBLY HAVING CONNECTOR SHROUD

(75) Inventor: Luke Antonio Cossette, Rochester, MN (US)

(73) Assignee: Tyco Electronics Corporation, Berwyn, PA (US)

( * ) Notice: Subject to any disclaimer, the term of this patent is extended or adjusted under 35 U.S.C. 154(b) by 218 days.

(21) Appl. No.: 12/949,135

(22) Filed: Nov. 18, 2010

(65) Prior Publication Data

US 2012/0129373 A1 May 24, 2012

(51) Int. Cl.
*H01R 13/64* (2006.01)

(52) U.S. Cl.
CPC ..... *H01R 13/64* (2013.01)
USPC ..... 439/567; 439/680

(58) Field of Classification Search
USPC ..... 439/680, 681, 567, 570, 571
See application file for complete search history.

(56) References Cited

U.S. PATENT DOCUMENTS 3,271,627 A * 9/1966 McDougal ..... 361/776
3,500,288 A * 3/1970 Reed et al. ..... 439/329
3,651,444 A * 3/1972 Desso et al. ..... 439/141
4,053,199 A * 10/1977 Hollyday et al. ..... 439/83
4,068,915 A * 1/1978 Evans ..... 439/637
4,173,387 A * 11/1979 Zell ..... 439/557
4,278,311 A * 7/1981 Scheingold et al. ..... 439/71
4,477,142 A * 10/1984 Cooper et al. ..... 439/575
4,547,840 A * 10/1985 Tinder ..... 362/646
4,588,854 A * 5/1986 Bailey et al. ..... 174/535
4,603,929 A * 8/1986 Fitzpatrick ..... 439/64
4,659,163 A * 4/1987 Althouse et al. ..... 439/607.55
4,664,462 A 5/1987 Owens
4,744,140 A * 5/1988 Bright ..... 29/741
4,812,133 A * 3/1989 Fleak et al. ..... 439/248
4,874,318 A * 10/1989 Spencer ..... 439/71
4,950,170 A * 8/1990 Miller, Jr. ..... 439/74
5,129,833 A * 7/1992 Rowlette, Sr. ..... 439/91
5,147,225 A * 9/1992 Kile et al. ..... 439/680
5,169,343 A * 12/1992 Andrews ..... 439/607.11
5,190,483 A * 3/1993 Viselli ..... 439/751
5,199,896 A * 4/1993 Mosquera ..... 439/329
5,199,900 A * 4/1993 Hayes, Sr. ..... 439/557
5,213,518 A * 5/1993 Weidler ..... 439/211
5,232,372 A * 8/1993 Bradley et al. ..... 439/66
5,254,019 A * 10/1993 Noschese ..... 439/681
5,259,789 A * 11/1993 Patel et al. ..... 439/570
5,277,618 A * 1/1994 Mitra ..... 439/564
5,415,566 A * 5/1995 Brunker et al. ..... 439/607.11
5,462,455 A * 10/1995 Reichle ..... 439/681
5,588,849 A * 12/1996 Kile ..... 439/83
5,634,810 A * 6/1997 Niitsu et al. ..... 439/378
5,637,019 A * 6/1997 Crane et al. ..... 439/677
5,655,914 A * 8/1997 McCartin et al. ..... 439/78
5,713,755 A * 2/1998 Koopman et al. ..... 439/378

(Continued)

*Primary Examiner* — Neil Abrams

(57) ABSTRACT

An electrical connector assembly is provided including a connector having a mating end. The connector has contacts extending from the mating end. A connector shroud is positioned around the mating end of connector. The connector shroud has an asymmetrical configuration and positioning tabs to orient the shroud on the panel. A mating connector having a mating end is configured to engage the mating end of the connector. The mating connector has mating contacts configured to engage the contacts of the connector. The mating end of the mating connector has an asymmetrical configuration that mirrors the asymmetrical configuration of the connector shroud. The asymmetrical configurations of the mating end of the mating connector and the connector shroud align the mating connector with the connector in a single orientation.

20 Claims, 4 Drawing Sheets

(56) References Cited

U.S. PATENT DOCUMENTS

| | | | | | |
|---|---|---|---|---|---|
| 5,718,606 | A * | 2/1998 | Rigby et al. | 439/607.1 |
| 5,751,556 | A * | 5/1998 | Butler et al. | 361/773 |
| 5,820,391 | A * | 10/1998 | Delprete et al. | 439/91 |
| 5,895,289 | A | 4/1999 | Smith | |
| 5,993,257 | A * | 11/1999 | Maruyama | 439/607.01 |
| 6,042,386 | A * | 3/2000 | Cohen et al. | 439/60 |
| 6,322,394 | B1 * | 11/2001 | Katoh et al. | 439/607.11 |
| 6,435,897 | B1 * | 8/2002 | Paul et al. | 439/374 |
| 6,464,542 | B1 * | 10/2002 | Lee | 439/680 |
| 6,585,539 | B2 * | 7/2003 | Ishikawa | 439/565 |
| 6,592,401 | B1 * | 7/2003 | Gardner et al. | 439/544 |
| 6,623,300 | B2 * | 9/2003 | Sakurai et al. | 439/607.25 |
| 7,252,532 | B2 * | 8/2007 | Sato | 439/374 |
| 7,351,091 | B1 * | 4/2008 | Zhang | 439/405 |
| 7,611,359 | B2 * | 11/2009 | Tomizu et al. | 439/74 |
| 7,722,393 | B1 * | 5/2010 | Huang et al. | 439/571 |
| 7,803,015 | B2 * | 9/2010 | Pham et al. | 439/555 |
| 7,883,350 | B2 * | 2/2011 | Byrnes et al. | 439/329 |
| 2013/0037396 | A1 * | 2/2013 | Yu | 200/293 |

* cited by examiner

ELECTRICAL CONNECTOR ASSEMBLY HAVING CONNECTOR SHROUD

BACKGROUND OF THE INVENTION

The subject matter described herein relates generally to electrical connectors and, more particularly, to electrical connectors having a connector shroud.

Electrical connectors generally include a mating end configured to be joined to a mating end of a mating connector. The connector and the mating connector include corresponding contacts. The contacts of the connector and the mating connector are configured to be coupled to provide an electrical connection between the connector and the mating connector. The contacts of the connector and the mating connector must be properly aligned so that corresponding contacts are mated.

However, conventional connectors are not without their disadvantages. Often connectors and mating connectors are capable of being coupled in a misaligned configuration. For example, the mating connector and the connector may be joined in a blind-mating scenario, wherein the connectors are not visible to the operator. As a result, a mating connector may be joined to a connector in an upside-down orientation. In another example, the mating connector may be improperly aligned with the connector when the mating connector and the connector are joined. Improper orientation of the mating connector and the connector may result in limited connections between the contacts. For example, only some of the contacts may be engaged. Additionally, the contacts of the mating connector may be engaged with the wrong contacts of the connector. As a result, electrical signals may be incapable of transmitting between the connector and the mating connector. In some cases, an improper connection between the connector and the mating connector may result in damage to the connectors and/or the electronic devices that are connected.

A need remains for a device that ensures proper alignment and connection of the connector and the mating connector.

SUMMARY OF THE INVENTION

In one embodiment, an electrical connector assembly is provided including a connector having a mating end. The connector has contacts extending from the mating end. A connector shroud is positioned around the mating end of connector. The connector shroud has an asymmetrical configuration. A mating connector having a mating end is configured to engage the mating end of the connector. The mating connector has mating contacts configured to engage the contacts of the connector. The mating end of the mating connector has an asymmetrical configuration that mirrors the asymmetrical configuration of the connector shroud. The asymmetrical configurations of the mating end of the mating connector and the connector shroud align the mating connector with the connector in a single orientation.

In another embodiment, an alignment assembly for a connector and mating connector is provided. The assembly includes a connector shroud configured to be positioned around a mating end of a connector. The connector shroud has an asymmetrical configuration. An alignment device is positioned on a mating end of a mating connector. The alignment device has an asymmetrical configuration that mirrors the asymmetrical configuration of the connector shroud. The asymmetrical configurations of the alignment device and the connector shroud aligning the mating connector with the connector in a single orientation.

In another embodiment, an electrical connector assembly is provided including a connector having a mating end. A connector shroud is positioned around the mating end of connector. The connector shroud has an asymmetrical configuration that mirrors an asymmetrical configuration of a mating connector. The asymmetrical configurations of the mating connector and the connector shroud aligning the mating connector with the connector in a single orientation.

DETAILED DESCRIPTION OF THE INVENTION

The foregoing summary, as well as the following detailed description of certain embodiments will be better understood when read in conjunction with the appended drawings. As used herein, an element or step recited in the singular and proceeded with the word "a" or "an" should be understood as not excluding plural of said elements or steps, unless such exclusion is explicitly stated. Furthermore, references to "one embodiment" are not intended to be interpreted as excluding the existence of additional embodiments that also incorporate the recited features. Moreover, unless explicitly stated to the contrary, embodiments "comprising" or "having" an element or a plurality of elements having a particular property may include additional such elements not having that property.

Figure 1:
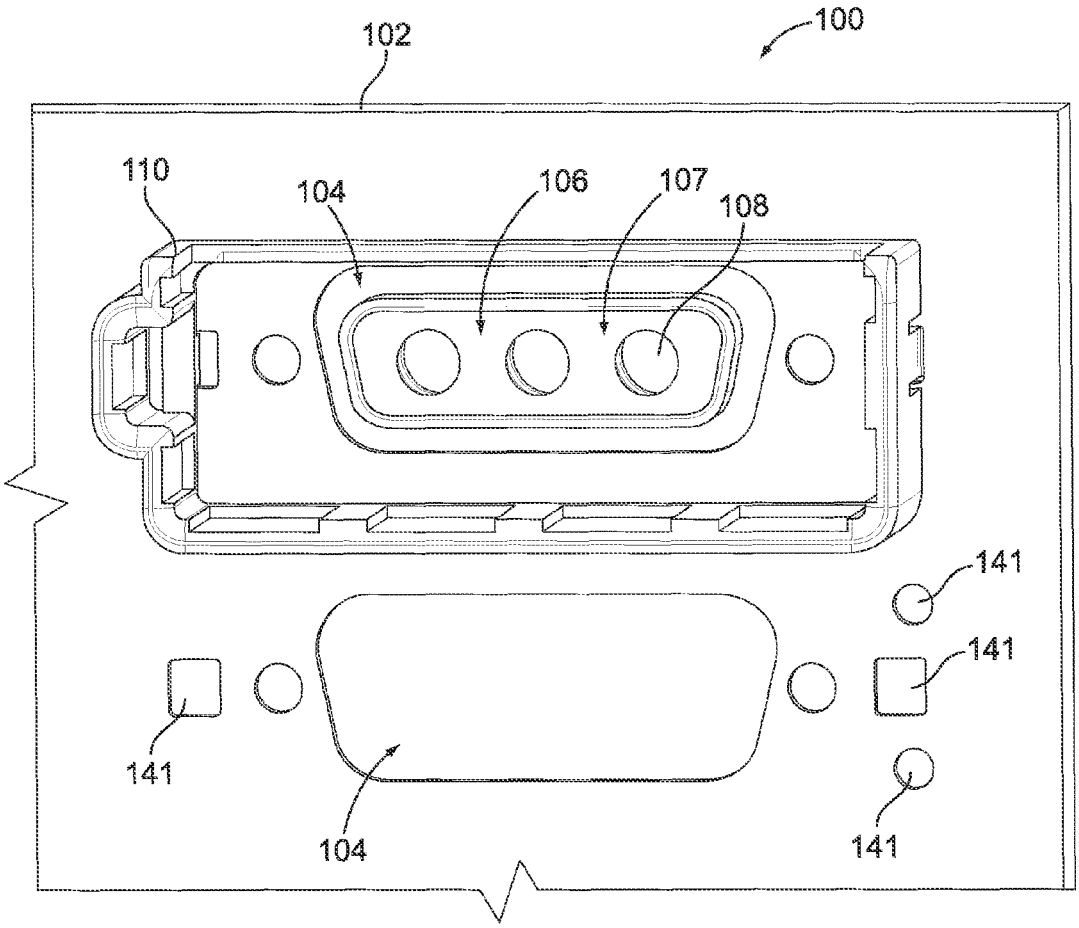
FIG. 1 is a front perspective view of an electrical connector assembly formed in accordance with an embodiment.

FIG. 1 illustrates an electrical connector assembly 100 formed in accordance with an embodiment. The electrical connector assembly 100 includes a panel 102. The panel 102 may be a wall of a mounting panel or an enclosure for an electronic device (not shown). In one embodiment, the panel 102 may be a substrate, for example, a circuit board or the like. The panel 102 includes openings 104 extending therethrough. Each of the openings 104 is configured to receive an electrical connector 106. A mating end 107 of the connector 106 extends through the panel 102. The mating end 107 of the connector 106 includes contacts 108 that extend therefrom. The mating end 107 of the connector 106 is configured to be coupled to a mating connector (shown in FIGS. 5 and 6). The connector 106 enables transmission of electrical signals, for example, data signals, power signals, or the like between the mating connector and another electrical device (not shown). The panel 102 may be capable of receiving any number of connectors 106.

A connector shroud 110 is positioned around each opening 104. The connector shroud 110 is positioned around the connector 106. The connector shroud 110 is positioned around the mating end 107 of the connector 106. The connector shroud 110 is coupled to the panel 102. In an exemplary embodiment, the connector shroud 110 includes coupling mechanisms 112 (shown in FIGS. 3 and 4) that are configured to join to apertures 141 in the panel 102. Alternatively, the connector shroud 110 may be adhered or otherwise coupled to the panel 102. The connector shroud 110 is configured to align the mating connector with the connector 106. The connector shroud 110 allows the mating connector to join the connector 106 in a single orientation. The connector shroud 110 prevents the mating connector from being inserted into the connector 106 in an inverted or misaligned orientation. The connector shroud 110 may also assist in blind-mating of the mating connector and the connector 106.

Figure 2:
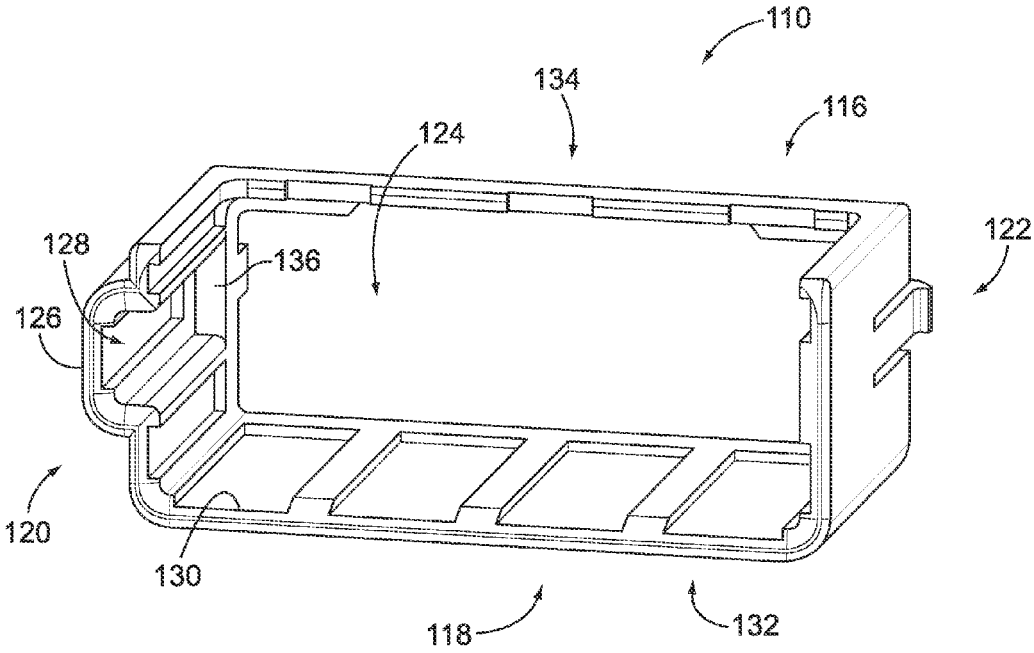
FIG. 2 is a front perspective view of a connector shroud formed in accordance with an embodiment.

FIG. 2 illustrates a front view of the connector shroud 110. The connector shroud 110 has an asymmetrical configuration. The connector shroud 110 includes a top 116 and a bottom 118. A first side 120 and a second side 122 extend between the top 116 and the bottom 118. An opening 124 extends through the connector shroud 110. The connector shroud 110 is configured to be positioned around the connector 106 (shown in FIG. 1) so that the connector 106 is accessible through the opening 124. The opening 124 is sized to receive the mating connector therein.

The first side 120 of the connector shroud 110 includes a keying feature 126 extending therefrom. The keying feature 126 is formed as a notch having an opening 128 therethrough. Alternatively, the keying feature 126 may have any shape or configuration that creates asymmetry in the connector shroud 110. In one embodiment, the keying feature 126 may be formed on any of the second side 122, top 116, and/or bottom 118 of the connector shroud 110. In one embodiment, the connector shroud 110 includes multiple keying features 126 formed on any of the first side 120, second side 122, top 116, and/or bottom 118 thereof. The keying feature 126 gives the connector shroud 110 an asymmetrical configuration. The connector shroud 110 includes an inner surface 130 that forms the opening 124. The inner surface 130 has an asymmetrical configuration. The asymmetrical configuration of the connector shroud 110 is configured to receive a mating connector having a like asymmetrical configuration. The asymmetrical configuration of the connector shroud 110 enables the mating connector to be coupled to the connector 106 in a single orientation.

The opening 128 of the keying feature 126 may extend any suitable distance between a front 132 and a back 134 of the connector shroud 110. In the illustrated embodiment, a flange 136 extends across the opening 128 of the keying feature 126. In one embodiment, the flange 136 is positioned proximate to the back 134 of the connector shroud 110. Optionally, the flange 136 may positioned at any intermediate location between the front 132 and the back 134 of the connector shroud 110. The flange 136 provides a stopping point for the mating connector. In one embodiment, the connector shroud 110 does not include the flange 136 and the mating connector is stopped by the panel 102 (shown in FIG. 1). In another embodiment, the flange 136 may include an aperture therethrough that is configured to receive a screw to secure the connector shroud 110 to the panel 102. In one embodiment, the flange 136 may include a coupling mechanism to secure the mating connector within the connector shroud 110.

Figure 3:
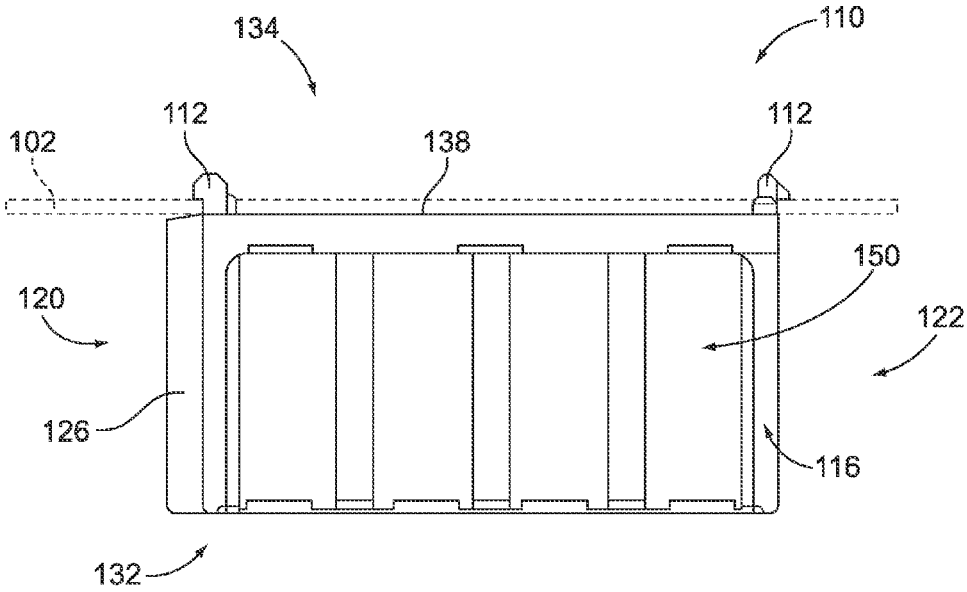
FIG. 3 is a top view of the connector shroud shown in FIG. 2.

FIG. 3 illustrates a top view of the connector shroud 110. The connector shroud 110 extends between the front 132 and the back 134. The back 134 of the connector shroud 110 is configured to abut the panel 102 when the connector shroud 110 is coupled to the panel 102. The back 134 of the connector shroud 110 includes a mating surface 138. The mating surface 138 is configured to abut the panel 102 so that the connector shroud 110 extends substantially perpendicular to the panel 102. The back 134 of the connector shroud 110 includes coupling mechanisms 112 extending therefrom. The coupling mechanisms 112 extend from the mating surface 138 of the connector shroud 110. In the illustrated embodiment, the coupling mechanisms 112 are formed as latches. The coupling mechanisms 112 are configured to be inserted into apertures 141 formed in the panel 102. The coupling mechanisms 112 secure the connector shroud 110 to the panel 102. The coupling mechanisms 112 secure the connector shroud 110 to the panel 102 so that the mating surface 138 of the connector shroud 110 abuts the panel 102. In an alternative embodiment, the coupling mechanisms 112 may be formed as pins and/or tabs that are inserted in the panel 102. Optionally, the panel 102 may include latches, pins, tabs, or the like that are configured to engage the connector shroud 110. In one embodiment, the connector shroud 110 may be adhered or otherwise coupled to the panel 102. In yet another embodiment, the connector shroud 110 may be formed integrally with the panel 102.

In the illustrated embodiment, the coupling mechanisms 112 are positioned proximate to the first side 120 and the second side 122 of the connector shroud 110. Alternatively, the coupling mechanisms 112 may extend from the top 116 (FIG. 2) and/or bottom 118 (FIG. 2) of the connector shroud 110. The coupling mechanisms may be positioned at any intermediate location between the first side 120 and the second side 122 of the connector shroud 110. In one embodiment, the connector shroud 110 may include coupling mechanisms 112 proximate to only one of the first side 120 and the second side 122 of the connector shroud 110.

The keying feature 126 extends between the front 132 and the back 134 of the connector shroud 110. The keying feature 126 may extend any distance between the front 126 and the back 134 of the connector shroud 110.

An opening 150 is formed in the top 116 of the connector shroud 110. The opening 150 extends from the front 132 toward the back 134 of the connector shroud 110. In the illustrated embodiment, the opening 150 extends partially to the back 134 of the connector shroud 110. In one embodiment, the opening 150 may extend any distance between the front 132 and the back 134 of the connector shroud 110. The opening 150 extends between the first side 120 and the second side 122 of the connector shroud 110. The opening 150 may extend any distance between the first side 120 and the second side 122 of the connector shroud 110.

The opening 150 provides access to the mating connector when the mating connector is inserted into the connector shroud 110. The opening 150 enables confirmation of connection between the mating connector and the connector 106. In one embodiment, the opening 150 may provide access to screws, pins, or the like configured to secure the mating connector to the connector 106. The opening 150 may also provide access for removing the mating connector from the connector 106. Accordingly, the mating connector may be removed from the connector 106 without having to pull on a cable joined to the mating connector.

Figure 4:
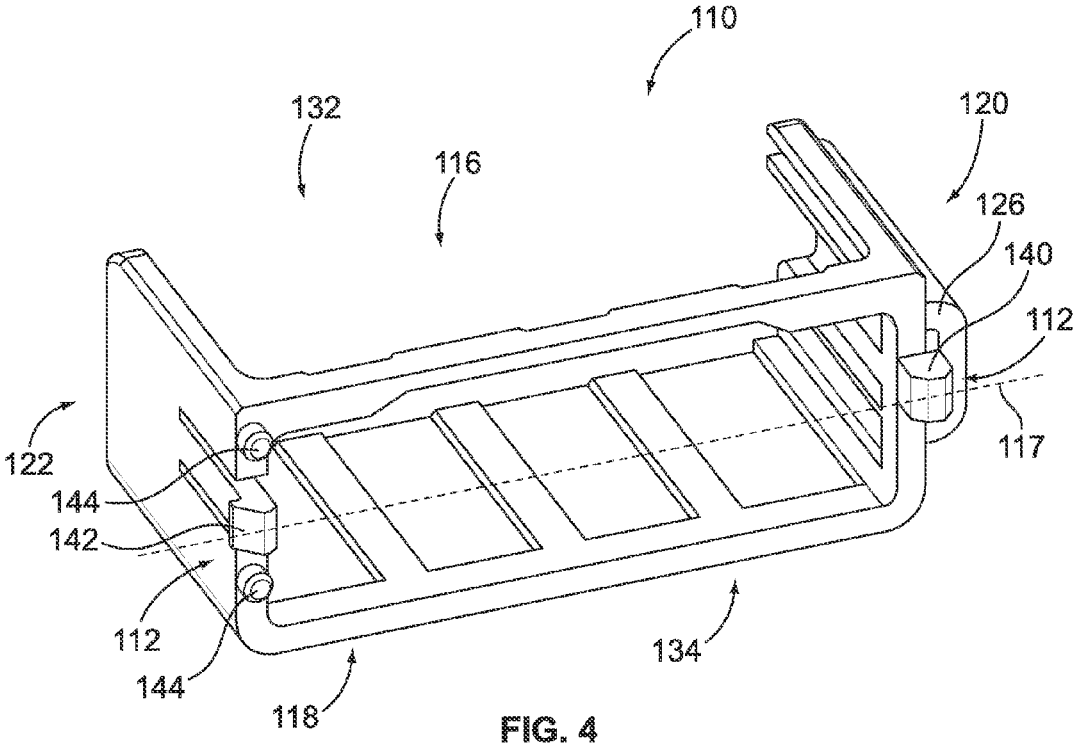
FIG. 4 is a rear perspective view of the connector shroud shown in FIG. 2.

FIG. 4 illustrates a rear perspective view of the connector shroud 110. The coupling mechanisms 112 extend from the back 134 of the connector shroud 110. A first side coupling mechanism 140 extends from the first side 120 of the connector shroud 110. The first side coupling mechanism 140 is positioned proximate to the keying feature 126. The first side coupling mechanism 140 is aligned with the keying feature 126. In one embodiment, the first side coupling mechanism 140 may be positioned at any location along the first side 120 of the connector shroud 110. In one embodiment, at least one first side coupling mechanism 140 may extend from any intermediate location between the keying feature 126 and the top 116 and/or bottom 118 of the connector shroud 110. The first side coupling mechanism 140 is formed as a latch that is configured to be inserted into an aperture 141 (shown in FIG. 1) of the panel 102.

A second side coupling mechanism 142 is positioned on the second side 122 of the connector shroud 110. The second side coupling mechanism 142 is formed as a latch. The second side coupling mechanism 142 extends from the back 134 of the connector shroud 110. The second side coupling mechanism 142 is configured to be received in an aperture 141 of the panel 102. A pair of positioning tabs 144 are provided proximate to the second side coupling mechanism 142. One positioning tab 144 is positioned between the second side coupling mechanism 142 and the top 116 of the connector shroud 110. Another positioning tab 144 is positioned between the second side coupling mechanism 142 and the bottom 118 of the connector shroud 110. The positioning tabs 144 may be located at any intermediate location between the top 116 and the bottom 118 of the connector shroud 110. The positioning tabs 144 are configured to be received in apertures 141 of the panel 102.

The first side coupling mechanism 140 and the second side coupling mechanism 142 are asymmetrically aligned with respect to the top 116 and the bottom 118 of the connector shroud 110. The positioning tabs 144 are also asymmetrically aligned with the first side coupling mechanism 140. The apertures 141 of the panel 102 receive the coupling mechanisms 140, 142 and the positioning tabs 144. The apertures 141 in the panel 102 are likewise asymmetrically aligned. Accordingly, the connector shroud 110 is capable of coupling to the panel 102 in only a single orientation. Coupling the connector shroud 110 to the panel 102 in a single orientation prohibits the mating connector from being misaligned with the connector 106. In one embodiment, the second side coupling mechanism 142 may be misaligned from the first side coupling mechanism 140 with respect to a central plane 117 of the connector shroud 110.

In one embodiment, the connector shroud 110 may include coupling mechanisms 112 extending from the top 116 and/or bottom 118 of the connector shroud 110. The coupling mechanisms 112 may be misaligned with respect to the central plane 117 of the connector shroud 110. The coupling mechanisms 112 may be provided at any location along the connector shroud 110. In an exemplary embodiment, the coupling mechanisms 112 are asymmetrically positioned about the connector shroud 110. Asymmetrically positioning the coupling mechanisms 112 about the connector shroud 110 allows the connector shroud 110 to be joined to the panel 102 in a single orientation.

Figure 5:
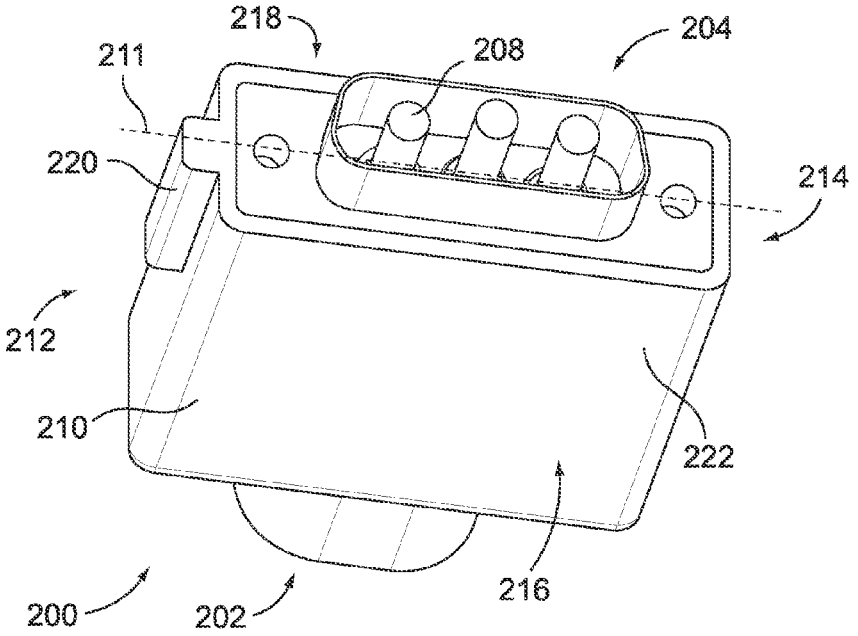
FIG. 5 is a front perspective view of a mating connector formed in accordance with an embodiment.

FIG. 5 illustrates a front perspective view of a mating connector 200 formed in accordance with an embodiment. The mating connector 200 includes a cable end 202 and a mating end 204. The cable end 202 is joined to wires of an electrical device. Alternatively, the cable end 202 may be joined to a substrate, for example, a circuit board. In one embodiment, the mating connector 200 is joined to a panel. The mating end 204 of the mating connector 200 may extend through an opening in a panel. The mating end 204 of the mating connector 200 is configured to couple to the mating end 107 of the connector 106 (shown in FIG. 1). The mating end 204 of the mating connector 200 includes contacts 208 extending therefrom. The contacts 208 are configured to engage the contacts 108 of the connector 106. The mating connector 200 is configured to engage the connector 106 to enable transmission of electrical signals between the mating connector 200 and the connector 106. The electrical signals may include data signals, power signals, or the like.

The contacts 208 of the mating connector 200 are configured to engage the contacts 108 of the connector 106 in a single orientation. Misalignment of the contacts 208 and the contacts 108 may result in a faulty signal between the mating connector 200 and the connector 106. Faulty signals may render the connectors 106 and/or 200 inoperable and/or cause damage to the connectors 106 and/or 200 and/or the electrical devices to which the connectors 106 and 200 are joined.

The mating connector 200 includes a housing 210. In an exemplary embodiment, the housing 210 operates as an alignment device. The housing 210 has an asymmetrical configuration. The asymmetrical configuration of the housing 210 mirrors the asymmetrical configuration of the connector shroud 110. The housing 210 includes a first side 212 and a second side 214. A top 216 and a bottom 218 extend between the first side 212 and the second side 214. The housing 210 includes a perimeter 222 extending therearound.

A keying feature 220 extends from the first side 212 of the housing 210. The keying feature 220 gives the housing 210 an asymmetrical configuration. The keying feature 220 creates asymmetry around the perimeter 222 of the housing 210. In the illustrated embodiment, the keying feature 220 is formed as a protrusion. Alternatively, the keying feature 220 may be formed as any suitable keying feature that corresponds to a keying feature formed in the connector shroud 110. The keying feature 220 is configured to be received within the keying feature 126 of the connector shroud 110. In one embodiment, the mating connector 200 may include any number of keying features 220 formed in any of the first side 212, second side 214, top 216, and/or bottom 218 of the housing 210. In an exemplary embodiment, the keying features are misaligned with respect to a central plane 211 of the housing 210 to create asymmetry in the housing 210. The mating connector 200 may include any number of keying features 220 that correspond to keying features 126 on the connector shroud 110.

The keying feature 220 of the mating connector 200 is configured to be received within the keying feature 126 of the connector shroud 110 to align the mating connector 200 and the connector 106. The asymmetry of the connector shroud 110 and the mating connector 200 enable the mating connector 200 to be coupled to the connector 106 in only a single orientation. The asymmetry of the connector shroud 110 and the mating connector 200 prevents the mating connector 200 from being coupled to the connector 106 in an inverted or a misaligned orientation. The asymmetry also enables the mating connector 200 to be blind-mated to the connector 106.

Figure 6:
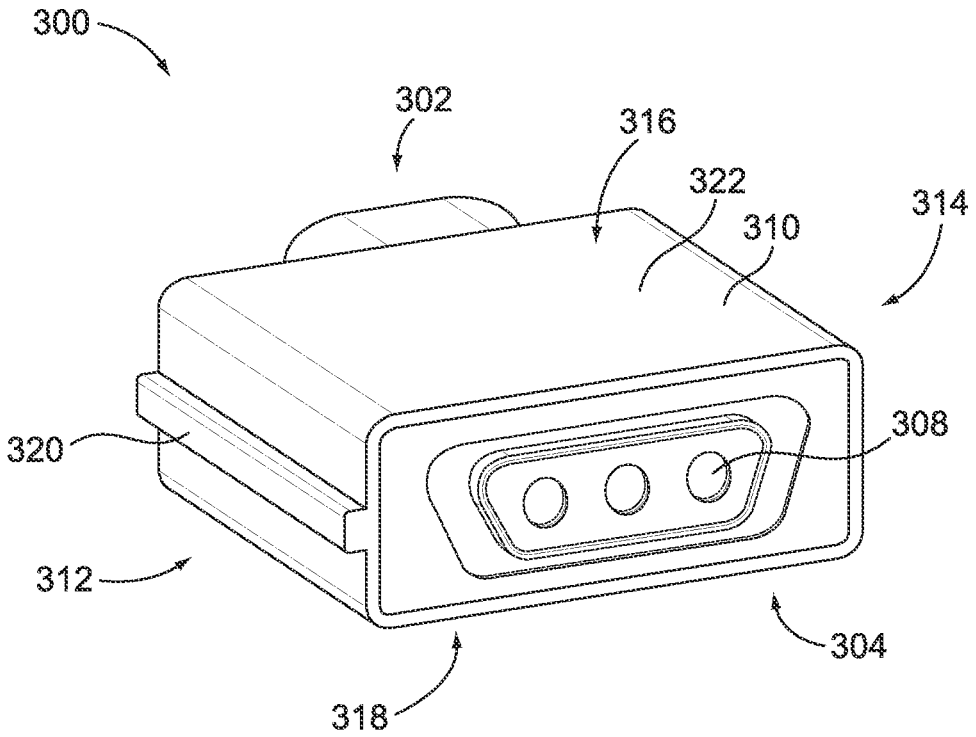
FIG. 6 is a front perspective view of a mating connector formed in accordance with an alternative embodiment.

FIG. 6 illustrates a front perspective view of a mating connector 300 formed in accordance with another embodiment. The mating connector 300 includes a cable end 302 and a mating end 304. The mating end 304 of the mating connector 300 includes contacts 308. The contacts 308 are socket contacts configured to engage the corresponding contacts of a connector mounted to the panel 102 to enable transmission of electrical signals between the mating connector 300 and the other connector.

The contacts 308 of the mating connector 300 are configured to be oriented in a single orientation. Misalignment of the contacts 308 may result in a faulty signal between the mating connector 300 and the other connector. Faulty signals may render the connector 300 inoperable and/or cause damage to the connector 300 and/or the electrical devices to which the connector 300 is joined.

The mating connector 300 includes a mating shroud 310. The mating shroud 310 is positioned around the mating end 304 of the mating connector 300. In an exemplary embodiment, the mating shroud 310 operates as an alignment device. The mating shroud 310 has an asymmetrical configuration.

The asymmetrical configuration of the mating shroud 310 mirrors the asymmetrical configuration of the connector shroud 110. The mating shroud 310 includes a first side 312 and a second side 314. A top 316 and a bottom 318 extend between the first side 312 and the second side 314. The mating shroud 310 includes a perimeter 322 extending therearound.

A keying feature 320 extends from the first side 312 of the mating shroud 310. The keying feature 320 gives the mating shroud 310 an asymmetrical configuration. The keying feature 320 creates asymmetry around the perimeter 322 of the mating shroud 310. In the illustrated embodiment, the keying feature 320 is formed as a protrusion. Alternatively, the keying feature 320 may be formed as any suitable keying feature that corresponds to a keying feature formed in the connector shroud 110. The keying feature 320 is configured to be received within the keying feature 126 of the connector shroud 110. In one embodiment, the mating shroud 310 may include any number of keying features 320 formed in any of the first side 312, second side 314, top 316, and/or bottom 318 of the mating shroud 310. In an exemplary embodiment, the keying features are arranged to create asymmetry in the mating shroud 310. The mating shroud 310 may include any number of keying features 320 that correspond to keying features 126 on the connector shroud 110.

The keying feature 320 of the mating shroud 310 is configured to be received within the keying feature 126 of the connector shroud 110 to align the mating connector 300 and the connector 106. The asymmetry of the connector shroud 110 and the mating shroud 310 enable the mating connector 300 to be coupled to the connector 106 in only a single orientation. The asymmetry of the connector shroud 110 and the mating shroud 310 prevents the mating connector 300 from being coupled to the connector 106 in an inverted or a misaligned orientation. The asymmetry also enables the mating connector 300 to be blind-mated to the connector 106.

Figure 7:
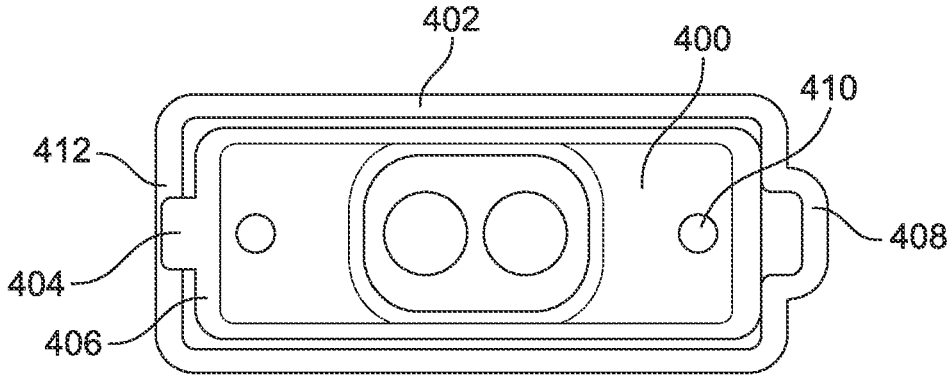
FIG. 7 illustrates a mating connector improperly aligned with a connector.

FIG. 7 illustrates a mating connector 400 improperly aligned with a connector shroud 402. The mating connector 400 has an asymmetrical configuration. The mating connector 400 includes a keying feature 404. The keying feature 404 is formed as a protrusion that extends from a side 406 of the mating connector 400. The keying feature 404 creates the asymmetrical configuration of the mating connector 400. The connector shroud 402 has an asymmetrical configuration. The asymmetrical configuration of the connector shroud 402 mirrors the asymmetrical configuration of the mating connector 400. The connector shroud 402 includes a keying feature 408. The keying feature 408 is formed as a notch extending from a side 410 of the connector shroud 402. The keying feature 408 creates the asymmetrical configuration of the connector shroud 402.

The mating connector 400 is configured to be inserted into the connector shroud 402 in a single orientation. The mating connector 400 is configured to be inserted into the connector shroud 402 so that the keying feature 404 is received within the keying feature 408. In the illustrated embodiment, the mating connector 400 is inverted with respect to the connector shroud 402. The keying feature 404 of the mating connector 400 is obstructed by a side 412 of the connector shroud 402, thereby preventing the mating connector 400 from being inserted into the connector shroud 402 in the inverted orientation. Accordingly, the asymmetrical configurations of the mating connector 400 and the connector shroud 402 prevent misalignment of the mating connector 400 and a corresponding connector.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the various embodiments of the invention without departing from their scope. While the dimensions and types of materials described herein are intended to define the parameters of the various embodiments of the invention, the embodiments are by no means limiting and are exemplary embodiments. Many other embodiments will be apparent to those of skill in the art upon reviewing the above description. The scope of the various embodiments of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112, sixth paragraph, unless and until such claim limitations expressly use the phrase "means for" followed by a statement of function void of further structure.

This written description uses examples to disclose the various embodiments of the invention, including the best mode, and also to enable any person skilled in the art to practice the various embodiments of the invention, including making and using any devices or systems and performing any incorporated methods. The patentable scope of the various embodiments of the invention is defined by the claims, and may include other examples that occur to those skilled in the art. Such other examples are intended to be within the scope of the claims if the examples have structural elements that do not differ from the literal language of the claims, or if the examples include equivalent structural elements with insubstantial differences from the literal languages of the claims.

What is claimed is:

1. An electrical connector assembly for mounting to a panel, the panel having an opening, the assembly comprising:

a connector having a mating end, the connector having contacts at the mating end, the connector being mounted to a rear of the panel with the mating end extending through the opening;

a connector shroud mounted to a front of the panel around the opening, the connector shroud having at least one positioning tab to orient the connector shroud in a single orientation relative to the connector, the connector shroud at least partially surrounding the mating end of the connector, the connector shroud having an asymmetrical configuration; and a mating connector having a mating end configured to engage the mating end of the connector, the mating connector having mating contacts configured to engage the contacts of the connector, the mating end of the mating connector having an asymmetrical configuration that mirrors the asymmetrical configuration of the connector shroud, the asymmetrical configurations of the mating end of the mating connector and the connector shroud aligning the mating connector with the connector in a single orientation.

2. The assembly of claim 1, wherein the mating end of the mating connector includes a mating shroud positioned at least partially therearound, the mating shroud being loaded through the opening in the panel, the mating shroud having an asymmetrical configuration that mirrors the asymmetrical configuration of the connector shroud.

3. The assembly of claim 1, wherein the connector shroud includes coupling mechanisms configured to join the connector shroud to the panel, the coupling mechanisms and the at least one positioning tab arranged so that the connector shroud aligns with the panel in a single orientation.

4. The assembly of claim 1, wherein the mating end of the mating connector includes a housing having the asymmetrical configuration.

5. The assembly of claim 1, wherein the connector shroud includes a first side and a second side, the first side having a keying feature formed therein.

6. The assembly of claim 1, wherein the mating connector includes a first side and a second side, the first side having a keying feature extending therefrom.

7. The assembly of claim 1, wherein the panel comprises at least one of a wall of a mounting panel, an enclosure for an electronic device, or a substrate.

8. The assembly of claim 1, wherein the connector shroud includes a body, the body comprising a first end and a second end, wherein the at least one positioning tab is positioned at the first end and the second end is devoid of a positioning tab.

9. The assembly of claim 1, wherein the connector shroud includes a body, the body comprising first and second ends, the first end includes a coupling mechanism and at least one positioning tab adjacent the coupling mechanism, the second end having a coupling mechanism, wherein each coupling mechanism and positioning tab extends at least partially into the panel.

10. An alignment assembly for electrical connectors comprising:

a panel having a front and a rear, the panel having an opening therethrough;

a connector having a mating end, the connector including multiple contacts at the mating end, the connector having a housing that commonly holds the contacts, the housing being mounted to the rear of the panel with the mating end extending through the opening;

a connector shroud mounted to the front of the panel, the connector shroud mounted around the opening, the connector shroud having at least one positioning tab to orient the connector shroud in a single orientation relative to the panel, the connector shroud configured to be positioned at least partially surrounding the mating end of the connector, the connector shroud having an asymmetrical configuration; and an alignment device positioned on a mating end of a mating connector, the alignment device having an asymmetrical configuration that mirrors the asymmetrical configuration of the connector shroud, the asymmetrical configurations of the alignment device and the connector shroud aligning the mating connector with the connector in a single orientation.

11. The assembly of claim 10, wherein the alignment device includes at least one of a mating shroud or a housing having the asymmetrical configuration.

12. The assembly of claim 10, wherein the connector shroud includes a first side and a second side, the first side having a keying feature formed therein.

13. The assembly of claim 10, wherein the alignment device includes a first side and a second side, the first side having a keying feature extending therefrom.

14. The assembly of claim 10, wherein the housing of the connector is mounted to the rear of the panel using another opening of the panel that is discrete from the opening of the panel.

15. An electrical connector assembly, the assembly comprising:

a panel having a front and a rear, the panel having an opening therethrough;

a connector having a mating end, the connector including multiple contacts at the mating end, the connector having a housing that commonly holds the contacts, the housing being mounted to the rear of the panel with the mating end extending through the opening; and a connector shroud mounted to a front of the panel around the opening, the connector shroud having at least one positioning tab to orient the connector shroud in a single orientation relative to the connector, the connector shroud positioned at least partially surrounding the mating end of the connector, the connector shroud having an asymmetrical configuration that mirrors an asymmetrical configuration of a mating connector, the asymmetrical configurations of the mating connector and the connector shroud aligning the mating connector with the connector in a single orientation.

16. The assembly of claim 15, wherein the asymmetrical configuration of the connector shroud complements an asymmetrical configuration of at least one of a housing of the mating connector or a mating shroud positioned around the mating connector.

17. The assembly of claim 15, wherein the connector shroud includes coupling mechanisms configured to join the connector shroud to the panel, the coupling mechanisms and the at least one positioning tab arranged so that the shroud aligns with the panel in a single orientation.

18. The assembly of claim 15, wherein the connector shroud includes a first side and a second side, the first side having a keying feature formed therein.

19. The assembly of claim 15, wherein the panel comprises at least one of a wall of a mounting panel, an enclosure for an electronic device, or a substrate.

20. The assembly of claim 15, wherein the housing comprises a dielectric material that electrically isolates the contacts from one another.

* * * * *